US006689226B1

(12) United States Patent
Cheung et al.

(10) Patent No.: US 6,689,226 B1
(45) Date of Patent: Feb. 10, 2004

(54) DECONTAMINATING ORGANIC GEL AND USE THEREOF FOR DECONTAMINATING SURFACES

(75) Inventors: David Cheung, Montpellier (FR); Philippe Rigal, Montepellier (FR); Stéphane Bargues, Les Vlis (FR); Frédéric Favier, Montpellier (FR); Jean-Louis Pascal, Montpellier (FR)

(73) Assignee: S.T.M.I. Société des Techniques en Milieu Ionisant, Gif sur Yvette (FR)

( * ) Notice: Subject to any disclaimer, the term of this patent is extended or adjusted under 35 U.S.C. 154(b) by 85 days.

(21) Appl. No.: 10/088,071

(22) PCT Filed: Sep. 19, 2000

(86) PCT No.: PCT/FR00/02592

§ 371 (c)(1),
(2), (4) Date: Mar. 20, 2002

(87) PCT Pub. No.: WO01/22431

PCT Pub. Date: Mar. 29, 2001

(30) Foreign Application Priority Data

Sep. 20, 1999 (FR) ..... 99 11741

(51) Int. Cl.[7] ..... C11D 1/72; C11D 3/26; C11D 3/37; C11D 3/20; B08B 3/04

(52) U.S. Cl. ..... 134/41; 134/2; 134/39; 134/40; 510/202; 510/203; 510/245; 510/254; 510/207; 510/476; 510/477; 510/480; 510/499

(58) Field of Search ..... 510/202, 203, 510/245, 254, 207, 476, 477, 480, 499; 134/39, 40, 41, 2

(56) References Cited

U.S. PATENT DOCUMENTS 4,529,450 A 7/1985 Panayappan

FOREIGN PATENT DOCUMENTS

| | | |
|---|---|---|
| EP | 0 047 857 | 3/1982 |
| EP | 0 566 493 | 10/1993 |
| FR | 2 380 624 | 9/1978 |
| FR | 2 656 949 | 7/1991 |
| FR | 2 695 839 | 9/1994 |
| FR | 2 746 328 | 9/1997 |
| FR | 2 781 809 | 2/2000 |
| JP | 49 037010 | 10/1974 |
| JP | 51 147486 | 12/1976 |
| JP | 54 006820 | 1/1979 |
| JP | 03 260081 | 11/1991 |
| WO | 00 40518 | 7/2000 |

*Primary Examiner*—Gregory Delcotto
(74) *Attorney, Agent, or Firm*—Oblon, Spivak, McClelland, Maier & Neustadt, P.C.

(57) ABSTRACT

The decontamination gel consists of one solution including:

a) a thickening agent;

b) an active agent of decontamination;

in which the thickening agent (a), is an agent exclusively organic, chosen among water-soluble organic polymers. This gel is usable for radioactive decontamination of surfaces, especially metallic surfaces.

39 Claims, No Drawings

DECONTAMINATING ORGANIC GEL AND USE THEREOF FOR DECONTAMINATING SURFACES

This invention relates to an organic gel of decontamination, usable for radioactive decontamination of surfaces, especially metallic surfaces.

According to the invention, "organic" gel is a gel in which thickening agents are essentially organic, in other words, excluding every inorganic or mineral substance.

Decontamination of parts tarnished by radioactive elements can be made either by mechanical treatments or by chemical ones.

The methods using mechanical treatments are disadvantageous in that they entail a more or less significant modification of the part's surface. Another disadvantage is that these treatments are difficult to apply on parts of complicated shape.

The methods of treatment by soaking essentially consist of carrying away radioactive elements fixed on the surface of the part by means of solution of actual appropriate agents of decontamination, especially of Ce(IV) stabilized in acid environment, highly concentrated such as nitric acid or sulfuric acid. These methods present the disadvantage of production of a large volume of effluents whose ulterior treatment, particularly by concentration, is very onerous.

Besides, the methods of treatment by soaking implementing solutions raise some problems in the treatment of pieces of large dimensions. It is very difficult to immerse and totally soak these pieces in the solution of reactors.

The solutions of decontamination, in effect, allow the treatment by soaking only for metallic disassembling pieces of limited sizes, in other words, in practice, these solutions can be practically utilized only in dismantling of radioactive installations.

On the other hand, the decontamination on the spot of radioactive installations, by spraying of watery solutions, produces large quantities of active effluents for a limited efficiency, because of a short-term contact with the pieces.

Thus, it has been suggested to transform into a viscose form the decontaminating solutions that include an active agent, which is formed by viscose/gelifying agents, in particular by solids divided in great specific areas, in small sizes of elementary particles and chemically inert.

Among the solids which comply with these requirements, supports of minerals, such as aluminum and silica, readily available in the market, present moreover a large diversity of their characteristics such as a hydrophilic or a hydrophobic character, pH, etc. and appear to be the best way to transform these solutions to viscose/gel form.

The spraying of such gels, unlike the solutions, can allow the decontamination on the spot of important metallic surfaces, which are not necessarily horizontal, but can be inclined or even vertical.

The decontaminating gels can be described as colloidal solutions including a thickening agent generally mineral, such as alumina or silica, and an active agent of decontamination, i.e. an acid, a base, an oxidizing agent, a reducing agent or a mixture thereof, which is chosen in function of the nature of the decontamination and the surface.

Thus, an alkaline gel for stainless steels and ferritic steels, will present the de-greasing properties for the elimination of the non-fixed contamination.

An oxidizing gel for stainless steels will perform the elimination of the heat or cold fixed contamination. A reducing gel will preferably be used in complement of the oxidizing gel and in an alternate way for the dissolving of oxides, heat-formed i.e. in the primary circuit of pressurized-water reactor.

Lastly, an acid gel for ferritic steels will perform the elimination of the contamination fixed in cold.

The utilization of gels for the radioactive decontamination of pieces is described particularly in document FR-A-2 380 624.

In this document, a decontaminating gel consisting of a colloidal solution of an organic or mineral compound is used in which one possibly adds a decontaminating product such as hydrochloric acid, stannous Chloride, oxine and/or sodium fluoride.

Though these gels give satisfying results, they sometime present the disadvantage of not being able to eliminate incrusted radioactivity only on a reduced depth of the part's surface, e.g. on a depth of about 1 $\mu$m.

Document FR-A-2 656 949 describes a decontaminating oxidizing gel which allows to eliminate radioactive elements deposited on the part, as well as radioactive elements incrusted on its surface.

This decontaminating gel is consists in a colloidal solution that includes:

a) from 8 to 25% by weight of a mineral-gelifying agent, preferably in silica, pyrogened silica or aluminum base;

b) from 3 to 10 mol/l of mineral base or of a mineral acid.

c) from 0.1 to 1 mol/l of an oxidizing agent such as $Ce^{IV}$, $Co^{III,}$ or $Ag^{II}$, that has a normal oxide-reduction potential $E_0$ higher than 1400 mV/EVH (standard hydrogen electrode) in a strong acid environment or in the reduced form of this oxidizing agent.

In the last case, the gel also includes from 0.1 to 1 mol/l of a compound (d), which is able to oxidize the reduced form of this oxidizing agent.

In the decontaminating gel described above, the presence of components (b) and (c) assures the elimination of radioactive accumulations, formed on the piece's surface as well as the elimination of incrusted radioactivity, by controlled erosion of the surface that has to be decontaminated.

However, this oxidizing gel does not present a sufficient effectiveness in relation to layers of adhesive metallic oxides, deposited on the surface of the alloy such as austenitic steels, Inconel 600 and Incoloy.

Document FR-A-2 695 839 describes, a reducing decontaminating gel which allows to eliminate these layers of adhesive metallic oxides, and which includes:

a) from 20 to 30% by weight of a mineral-gelifying agent, preferably of alumina base.

b) from 0.1 to 14 mol/l of a mineral base, such as NaOH or KOH, and c) from 0.1 to 4.5 mol/l of a reducing agent, that has a potential of oxide-reduction, less than −600 mV/ENH in an environment of a strong base (pH≧13), chosen among the borohydrides, sulphites, hydrosulphites, sulfides, hypophosphites, zinc and hydrazine.

The application of gels on the surface, for example the metallic surface, is preferably accomplished by spraying, for example under a pressure that could range from 50 to 160 bars and beyond, the gel being agitated before the spraying to transform it into a homogenous gel. After a proper duration of action, the gel is rinsed by spraying water, then the effluents generated are treated by neutralization, decantation and filtration.

All the gels described above, whether they be alkaline or acid, reducing, or oxidizing, present the advantages already mentioned such as the possibility to treat the pieces of complicated shape, an easy application, a small quantity of sprayed chemical radioactive elements by specific area, i.e. a small quantity of effluents, produced by rinsing the applied gels and a perfectly controlled time of contact with the surface, hence a control of the erosion during decontamination. Moreover, the fact that it is possible to spray the gel in a distance significantly diminishes the amounts absorbed by the agents meant for the radioactive purification.

The typical gels of prior art are marketed by "F.E.V.D.I." company, under the name of "FEVDIRAD".

All the gels mentioned above, whether they be alkaline, reducing and especially oxidizing, present a corrosive power.

Unfortunately, they cannot stand the high shearing velocities imposed by spraying, which is the most traditional process for the application of gels.

In fact, all these gels including a mineral thickening agent, particularly silica, whether it be hydrophilic, hydrophobic, basic, or acid, have rheological properties, characterized by a thixotropic behavior; during the spraying, the viscosity diminishes under shearing, while after the cessation of shearing, the resetting process of the adhering gel on the surface starts. Such a fluid is characterized by a rheogram in hysteresis.

The control of this thixotropy is fundamental to allow a spraying and an optimal adherence of the gel onto the surface that has to be treated. The speed of the resetting process of the gel, either partial or total, is the most important concept for the spraying of gels.

Indeed, the resetting process means a return to the gelification, hence an adherence on the surface and a short resetting time characterizes a gel, which quickly recuperates a sufficient viscosity after spraying to prevent any sagging.

Whatever the charge in mineral thickening agent of the gels described above or currently marketed, the resetting times are too long. For example, for various charges in Cab-o-Sil® M5, which is a hydrophilic pyrogen silica and acid marketed by "DEGUSSA" company, the resetting times are always longer than 5 seconds, which is very excessive.

The period of return to a sufficient viscosity, in order for the gel to adhere on the surface, can be very short, but this requires a significant increase of the mineral charge.

Before the spraying, the viscosity under agitation is high and the process of spraying becomes difficult. Furthermore, this increasing mineral charge produces large quantities of rinsing effluents and solid waste for treatment.

For example, after the treatment by filtration of the rinsing effluents, 20 kg of gel give a volume of radioactive waste corresponding to a barrel of 200 liters.

There is a chance to improve the rheological properties of the gels described above including a thickening agent, exclusively mineral, consists in micrometric particles of smoked silica or by a mixture of alumina and silica. The rheological properties of these gels can be improved by reducing their mineral charge and in the same time, without affecting their corrosive qualities.

Such improvements have been obtained in document FR-A-2 746 328 which describes an organic mineral gel of decontamination consisting of a colloidal solution that includes a thickening agent and an active agent of decontamination. The thickening agent includes the combination of a mineral thickening agent, such as silica or aluminum, and an organic thickening agent or co-thickening chosen among the water-soluble organic polymers, such as the polymer of the acrylic acid and its copolymers with acrylamide.

According to this document, the incorporation of decontaminating gel in the viscose gel, in addition to a mineral thickening agent (called co-thickening), allows to improve Theological properties of gels, and to significantly diminish their mineral charge and the produced solid waste without affecting corrosive properties and their qualities of decontamination.

The addition of the organic co-thickening agent leads to a diminution of the mineral's charge, which in this case is about 5% by weight, instead of 20% by weight, for the previous gels. This fact appeals the thickening agents and especially mineral ones.

The gels described in this document can be perfectly projected, easy to eliminate by rinsing after application. In addition, they present an easy filtration at the time of the treatment of the effluents and a diminished volume of the final solid waste as well.

Besides, the polymer or surfactant organic co-thickening agent is easy to deteriorate at the time of the treatment of the effluents.

However, though diminished to approximately 5%, the mineral charge of gels described in document FR-A-2 746 326 is still important, since it is generally about 5%, which involves the need for a more complex system of filtration.

In addition, the personnel who intervene to recuperate this residual mineral charge is exposed to a certain dose of radiation.

Besides, it is important to reduce in a general way, the volume of solid waste, produced during the process of decontamination, considering the problems of storage and protection of environment.

Therefore, there is a need for a decontaminating gel whose mineral charge, which comes from the thickening agent, is quite diminished, even substantially cancelled, in order to generate a minimal volume of solid waste. This diminution or suppression of the mineral charge should be obtained without affecting the other properties of the gel.

These other properties, that should not be affected, are particularly rheological properties. The resetting time should be the shortest possible and the system should be sufficiently liquid under agitation, to allow one spraying.

In addition, the corrosive qualities of these gels should not be deteriorated and the obtained decontamination factors should be at least as identical as those of existing gels.

The object of this invention is to provide a decontaminating gel, which satisfies all needs mentioned above.

Another object is to provide a decontaminating gel, which does not present the disadvantages, limitations and inconveniences of the methods of prior art and which resolves all the problems of prior art.

This goal and others are reached, according to the invention, by a decontaminating gel, which consists of a solution that includes:

a) a thickening agent;

b) an active agent of decontamination;

in which the thickening agent (a) is a thickening agent exclusively organic chosen among the water-soluble organic polymers.

According to the invention, the gels do not contain any viscose minerals such as silica or alumina. Consequently, because of the mineral charge, which is null, all the inconveniences due to solid waste created by this mineral discharge are eliminated, particularly a system of filtration and expensive and complex recuperation of these waste is no longer necessary.

The waste produced in small quantities contains only organic products, which can be easily deteriorated, such as compound of carbon, nitrogen, oxygen and hydrogen, without prohibited elements in the nuclear such as sulphur or halogen.

It should be noted that this total suppression of every mineral thickening agent is obtained without affecting the other fundamental properties in a negative way. The fundamental properties are especially Theological and corrosive properties as well. Particularly, the factors of decontamination obtained with the gels of the invention are completely comparable, even superior to analog ones of the prior art, which means the gels include the same agent of decontamination, but they consist of mineral thickening agent alone or in combination with a viscose, like in document FR-A-2 746 328.

Surprisingly, the gels according to the invention, keep their characteristic structure much longer than gels, which include a mineral thickening agent, and dry much faster, while preserving their properties of corrosion. Their elimination by rinsing is thus made easier and the volume of rinsing effluents diminishes.

Moreover, the gels in this invention are quite resistant under temperature i.e. up to 80° C. or in other words an excellent resistance to heat, i.e. the recycling and the corrosion properties of these gels are, preserved among others, at high temperatures, This characteristic is especially important in certain specific utilizations where surfaces to be treated are permanently under high temperatures i.e. greater than or equal to 40° C.

The preparation of the gel according to the invention is easy and fast and it appeals only to reagents, which are easily available and are cheap; so, the gels according to the invention can be implemented on a large scale and on an industrial plan.

The gels according to the invention are the result of a surprising undertaking, contrary to what could have been expected. In fact, nothing would make one expect that total suppression of the thickening mineral in gels of the prior art presented in FR-A-2 746 328 would lead to gels with all required features, especially regarding their rheology.

So it is evident that if we increase the quantity of thickening organic agent in the gel compositions of document FR-A-2 746 328, in order to compensate a diminution of the mineral charge (carried out to reduce the mass of waste), the obtained viscosity was not sufficient to contemplate a use by spraying and even a liquid was obtained if the concentration of the co-thickening agent increases.

Unexpectedly, according to the invention, totally concealing the mineral thickening agent does not bring the expected effects such as degradation of gel properties, but in contrary, leads to a gel with all required characteristics and even more.

The invention triumphs over a presumption and resolves the problems of the prior art.

According to essential characteristic of the invention, the thickening agent (a) is a thickening agent exclusively organic, which is chosen among the water-soluble polymers.

These polymers can be used in the gel in a percentage generally ranging from 1 to 11%, preferably 2 to 8% by weight or 4 to 6% by weight; in these amounts, they allow especially a significant improvement of rheological properties of gels and a total suppression of the mineral charge i.e. in alumina and/or in silica. The polymer has generally a molar mass defined by the average molar mass by weight from 200,000 to 5,000,000 g/mol. By polymer, according to the invention, one understands the homopolymers as well as copolymers, sequence or statistic.

Preferably, this polymer should meet a number of conditions related, in particular, to its utilization in the nuclear facilities.

First, it should be soluble.

It should not contain either sulphur or halogen, such as fluorine or chlorine prohibited in the nuclear domain, it should participate minimally in the global organic charge, it should be resistant in presence of the active agents of decontamination (b); for example a good resistance in acid and/or oxidizing environment or even in basic and/or reducing environment. Moreover, it should be little sensitive to the ionic force of environment and it should be thermally stable at the temperatures generally from 0 to 50° C. and beyond.

Among the numerous water-soluble organic polymers, it has been evident that the polymer of acrylic acid and its copolymers with acrylamide fulfilled these criteria and allowed the preparation of a gel meeting the requirements mentioned above.

The polyacrylic acid polymer is consists in the repetition of the monomeric unit (I) as follows: —$CH_2CH(CO_2H)$—. The average molar mass by weight of the polyacrylic acid polymer is from 450,000 to 4,000,000. The average molar mass by weight is preferably 4,000,000. In fact, it has been obvious that the formation of one gel needs increasing percentages of polymer, with the diminution of the macromolecular chain. This is due to the fact that an important average molar mass by weight corresponding to longer length of chain should favor a better reticulation and so, the formation of a more viscous gel for a smaller quantity of polymer.

The copolymers of acrylic acid with acrylamide have an average molar mass by weight ranging from 200,000 to 5,000,000, preferably from to 200,000 to 4,000,000.

The percentage of each of the monomers in the copolymer of acrylic acid and acrylamide is variable; the copolymer will generally include from 95 to 60% by weight of acrylic acid and from 5 to 40% by weight of acrylamide.

A preferred copolymer is a copolymer of an average molar mass by weight of 200,000 and whose percentage by weight of acrylamide is 10%.

These copolymers can be block or random copolymers. The random copolymer, of formula (I)

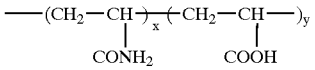

(I)

is thus structured from two types of blocks of variable lengths. One of the blocks is consists in acrylic acid monomeric units and the other one for acrylamide monomeric units.

Examples of suitable acrylic acid-acrylamide copolymers are the copolymers marketed by the SCOTT BADER® company, under the name of TEXIPOL®, such as TEXIPOL® 63–510. This product is presented in the form of a watery solution of 25% of a polyacrylic acid-acrylamide copolymer (molar mass: $10^6$; percentage of acrylamide is from 20 to 30%) dispersed in an organic phase composed of white spirit of toluene or isopar of 20% in the form of emulsion with 5% surfactant.

Possibly, the gels according to the invention can also include an organic surfactant that is included in the organic thickening agent.

The surfactants of the family of polyoxyethylenic ether of formula (II):

$$CH_3—(CH_2)_{n-1}—(O—CH_2—CH_2)_n—OH \quad (II)$$

called $C_nE_m$, meet the required criteria i.e., among others, a sufficient stability, especially in very acid, very oxidizing and electrolytically high media, such as decontaminating gels.

In the above formula, n defines the length of the aliphatic chain and is an integer that can vary from 6 to 18, preferably from 6 to 12; m defines the size of the polar head and is an integer that can vary from 1 to 23, preferably from 2 to 6.

Among these surfactants, the preferred compounds are: $C_6E_2$ (hexyl of di(ethylene glycol) ether), $C_{10}E_3$ and $C_{12}E_4$.

Such compounds $C_nE_m$ are available from ALDRICH and SEPPIC® companies.

The nature of the surfactant depends on the type of the decontaminating gel implemented, i.e. the nature and the content of the active agent of decontamination (b) and the nature and the content of the polymer organic thickening agent.

Thus, the compounds $C_nE_m$ are particularly adapted to be used in the gels that include polyacrylic acid and especially in the acid oxidizing gels that include polyacrylic acid.

In addition, the content in surfactant depends on the nature of the decontaminating gel and on the concentration and nature of the organic thickening agent.

This content in surfactant will generally range from 0.1 to 5% by weight, preferably from 0.2 to 2% by weight and even more preferably from 0.5 to 1% by weight.

The thickening agent (a) according to the invention can be used in any decontaminating gel whatever the type, i.e. whatever the active agent of decontamination (b) implemented in the decontaminating gel.

The thickening agent (a) can especially be used instead of the exclusively mineral thickening agent, implemented in any of the decontaminating gels of the prior art as described for example in documents FR-A-2 380 624; FR-A-2 656 949 and FR-A-2 695 839, or it can be implemented instead of the thickening agent that consists of the combination of a mineral thickening agent and an organic thickening agent described in document FR-A-2 746 328.

We have seen that the decontaminating gels have different natures depending on the active agent of decontamination (b) they contain; they are gels called alkaline, acid, reducing and oxidizing.

Thus, the decontaminating gel according to the invention can contain as an active agent of decontamination (b), an acid, preferably a mineral acid, chosen preferably among hydrochloride acid, nitric acid, sulfuric acid, phosphoric acid and mixtures thereof.

The acid is generally present in a concentration ranging from 1 to 10 mol/l, preferably from 3 to 10 mol/l.

Such a gel, called "acid gel", is particularly adapted to eliminate the cold-fixed contamination on the ferretic steels.

In this type of acid gel, the thickening agent is preferably a polyacrylic acid, preferably high average molar mass by weight, i.e. higher or equal to 450,000, for example around 4,000,000.

In this type of gel, the thickening agent is generally present in a concentration of 3 to 12% by weight.

The decontaminating gel according to invention can also contain as an active agent of decontamination (b), a base, preferably a mineral base, chosen preferably among the soda, potasium and mixtures thereof.

The base is generally present in a concentration of 0.1 to 14 mol/l.

Such a gel called "alkaline gel" has interesting degreasing properties and is particularly adapted to eliminate the non-fixed contamination on the stainless steels and ferritic acids.

In this type of alkaline gel, the thickening agent is preferably an acrylic acid acrylamide copolymer, for example the type TEXIPOL® 63–510.

A typical example of decontaminating gel, basic or alkaline according to the invention is consists in a solution that includes:

from 9 to 11% by weight of an acrylic acid acrylamide copolymer of an average molar mass by weight of 200,000 and contains 20% of acrylamide by weight;

from 1 mol/l to 12 mol/l of soda, preferably 3 mol/l;

Such a basic thixotropic gel according to the invention without any thickening mineral charge has the following properties:

a lifetime of about one week;

a time of synthesis of 2 days;

Theological properties allowing the spraying without sagging;

easy rinsing with water in low pressure.

It should be noted that this gel does not need any heating during its synthesis.

The decontaminating gel according to the invention can also contain as an active agent of decontamination (b) a reducing agent that can be for example the agent described in document FR-A-2 695 839, in which the reducing agent used is a reducing agent that includes a normal potential of oxide-reduction $E_o$ less than −600 mV/ENH (standard hydrogen electrode) in a high base medium (pH 13).

Examples of such reducing agents include borohydrides, sulphites, hydrosulphites, sulfides, hydrophosphites, zinc, hydrazine and mixtures thereof.

When borohydrides, sulphites, hydrosulphites, sulfides, hydrophosphites are used, they are in a metallic salt form, for example, salts of alkaline metals such as sodium.

When the sodium borohydride is used as reducing agent, the pH of the colloidal solution is preferably greater than or equal to 14, so that the borohydride remains stable.

The reducing agents, like it is described in document FR-A-2 695 839, are generally associated with a mineral base such as NaOH or KOH, in a concentration generally ranging from 0.1 to 14 mol/l. The concentration in reducing agent generally ranges from 0.1 to 4,5 mol/l.

In such a reducing gel, the thickening agent is rather an acrylic-acrylamide acid copolymer, for example of the type TEXIPOL® 63–510.

Such a gel called "reducing gel" is generally used in complement and alternately with an oxidizing gel such as the one described below.

Such a gel allows especially to weaken and to move the metallic layers of oxide superficially adherent which are heat-deposited on the surface of alloys, such as austenitic stainless steels, Inconel and Incoy that form the primary circuits of pressurized-water reactors, which are not sensitive to the action of oxidizing decontaminating gel.

A typical example of the reducing decontaminating gel according to the invention is consists in the solution, which includes:

from 9 to 11% by weight of copolymer acid acrylic-acrylamide of average mass molar by weight 200,000, and containing 20% by weight of acrylamide;

from 1 to 12 mol/l of soda, preferably 3 mol/l;

from 1 to 4 mol/l of $NaBH_4$, preferably 3 mol/l;

A gel reducing agent according to invention has the following characteristics:

the lifetime of gel is one week;

the time of synthesis is 2 days;

the rheological properties allow the spraying without sagging;

the rinsing is done in water under low pressure;

This gel does not require any heating during for its synthesis.

The gel of decontamination according to the invention can still contain, as active agent of decontamination b) an oxidizing agent.

This oxidizing agent can be, for example, an oxidizing agent such as the one described in document FR-A-2 656 949 in which the oxidizing agent used is an oxidizing agent that must have a normal potential of oxidation-reduction of more than 1400 mV/ENH in a strong acid environment (pH<1), which means an oxidizing power superior to the permanganate's.

$Ce^{IV}$, $Co^{III}$, $Ag^{II}$ and their mixtures can be mentioned as example of oxidizing agents.

In fact, the potentials of oxidation-reduction pairs corresponding to these oxidizing agents have the following values:

| | |
|---|---|
| Ce III/Ce IV | Eo/ENH = 1610 mV |
| Co II/Co III | Eo/ENH = 1820 mV |
| Ag I/Ag II | Eo/ENH = 1920 mV |

The use of these powerful oxidizing agents is particularly suitable when the surface to decontaminate is a metallic surface, for example in noble alloy, such as non-oxidizable steels 304 and 316L, Inconel and Incolloy.

Furthermore, these oxidizing agents can also oxidize some colloidal oxides not very soluble such as the $PuO_2$, in order to turn them into a soluble form such as $PuO_2^{2+}$.

In the decontaminating gel of the invention, the oxidizing agent can also be used in its reduced form, $Ce^{III}$, $Co^{II}$, $Ag^{I}$ can be used for example, on condition that a compound able to oxidize this reduced form is added to the gel, or on condition that the gel is associated to another gel or to another colloidal solution, which contains a compound able to oxidize this reduced form of the oxidizing agent.

The compound able to oxidize the reduced form of the oxidizing agent can be made up of a persulfate of alkaline metal.

The oxidizing agents, of which Cerium (IV) is preferred, are generally associated to a mineral basis, or for more stability to a mineral acid such as HCl, $H_3PO_4$, $H_2SO_4$ and preferably to $HNO_3$ at a concentration of 1 to 10 mol/l, preferably of 2 to 10 mol/l, preferably of 2 to 3 mol/l, for example 2,88 mol/l, the concentration in an oxidizing agent being in general within 0,1 to 2 mol/l, preferably within 0,6 to 1,5 mol/l preferably again this concentration is of 1 mol/l. When using an oxidizing cation such as $Ce^{IV}$, $Ag^{II}$, or $Co^{III}$ as oxidizing agent, it can be entered as one of the salts like nitrate, sulfate or another, but can also be electro generated.

The preferred oxidizing gels contain Cerium (IV) in the form of electro generated nitrate of Cerium (IV) $Ce(NO_3)_4$, or hexanitrato cerate of di-ammonium $(NH4)_2Ce(NO_3)_4$, the latter being preferred because of the relative instability of the nitrate of cerium (IV) in a nitric concentrated environment.

The nitric acid stabilizes the cerium at a degree IV of oxidation, takes part in the corrosion and assures, among other things, the maintaining in solution of the corroded species, which means of oxo-nitrate coordination of metals of transition constitutive to metallic alloy.

Such gels contain the organic thickening agent, preferably the polyacrylic acid at a coordination generally of 2 to 12% as weight.

Preferably, in this type of gel, the thickening agent is a polyacrylic acid, preferably a polyacrylic acid of average molar mass of relatively elevated weight, for example 4,000,000, but TEXIPOL can also be used, for example TEXIPOL 63–510, already described above.

This type of gel can also comprise, in addition to said thickening agent, a tension-active agent or surfactant such as described above, preferably $C_6E_2$ or $C_{12}E_4$, at a coordination of 0,1 to 1,5% in weight.

A first typical example of decontaminating oxidizing gel according to the invention is made up of a solution comprising:

10 to 13% by weight of acrylic acid—acrylamide copolymer with weight-average molecular weight of 200,000 and containing 20% of acrylamide.

2 to 3 mol/l preferably 2.88 mol/l of $HNO_3$;

0,1 to 2 mol/l of $(NH_4)_2Ce(NO_3)_6$.

Such an oxidizing gel has the following properties:

lifetime of one week;

synthesis time between 2 and 10 days;

rheological properties allow spraying without running;

corrosive power of 0.3 $\mu$m/2 hours/kg/m$^2$;

easy rinsing with water under low pressure.

A second typical example of the oxidizing decontamination gel according to the invention formed by a solution containing:

7 to 8% by weight of polyacrylic acid with a weight-average molecular weight of 450,000;

2 to 3 mol/l, preferably 2.88 mol/l of $HNO_3$;

0.1 to 2 mol/l of $(NH_4)_2Ce(NO_3)_6$;

up to 1% by weight of the surfactants preferably $C_6E_2$ or $C_{12}E_4$.

Such oxidizing gel containing polyacrylic acid as thickening agent presents the following properties:

lifetime between 2 and 5 days;

synthesis time approximately 2 days;

theological properties allowing spraying without running; corrosive power between 0.3 and 0.7 $\mu$m/2 hours/kg/m$^2$.

A third typical example of the oxidizing decontamination gel according to the invention is formed by a solution containing:

0.6 to 1.2 mol/l preferably 0.9 mol/l of $(NH_4)_2Ce(NO_3)_6$ or $Ce(NO_3)_4$, 2 to 3 mol/l, preferably 2.88 mol/l of $HNO_3$, 3,0 to 4,5% by weight, preferably 3,7% by weight of an acid polyacrylic with weight-average molecular weight of 400 000.

The characteristics of this gel are as follows:

Rheology: the time for setting is 1s and the viscosity is 12000 mPa.s in 5s$^{-1}$.

Corrosion: 1,33 $\mu$m/4 hours for 1 kg of gel per m$^2$, that is, 0,3 $\mu$m/h; 1,07 $\mu$m for 1 hour of application at 40° C.; 0,95 $\mu$m for ½ hour of the application at 80° C.

Lifetime of gel: approximately 24 hours.

Rinsing: very easy under water with low pressure.

The decontamination gels described above could be used in particular for the decontamination of metal surfaces as well as in the scope of periodic maintenance of existing installations, and of dismantling nuclear installations.

The gels according to the invention could be used for example for decontamination of tanks, of the fuel storage containment pool, glove boxes, etc.

Also, the invention has for a goal, a decontamination process of a metal surface, that consists of the application of the decontamination gel according to the invention on the surface to be decontaminated, keeping this gel on the surface during a sufficient period to carry out the decontamination, this period could be between 10 min to 24 hours, preferably from 30 min to 10 hours, and preferably still from 2 to 5 hours, and for example, the removal of the gel from the metal surface so treated by rinsing it or by mechanical action.

According to this important and very particular According to this particularly important aspect of the invention due to the excellent properties of behaviour of the gels according to the invention with temperature, the surface to be decontaminated could be a surface whose temperature is, even permanently, greater than or equal to 40° C., for example, from 40° C. to 80° C.

The quantities of the gel deposited on the surface to be decontaminated are in general from 100 to 2,000 g/m$^2$ preferably from 100 to 1000 g/m$^2$, preferably still from 200 to 800 g/m$^2$.

It is obvious that we could repeat the treatment many times each time by using the same gel or the gels of different types during different successive stages, each of these stages consisting of the application of a gel, maintaining the gel on the surface, and removal of the gel from the surface, for example by rinsing or mechanical action.

Likewise, the treatment could be repeated over the entire surface to be treated or over only one part of that presenting for example a complex form, or as a function of the surface activity (mRad/h) with certain specific points of the latter requiring intensive treatment.

Also, one or more rinsings of the decontaminated surfaces may be carried out, in particular before the first application of the gel, with the aid of water or with an aqueous solution, preferably under high pressure, in order to cleanse and/or to degrease the surface to be treated.

For example, the decontamination procedure could comprise the following successive stages as is described in the document FR-A-2 695 839:

1) Apply on the surface to be decontaminated a reducing decontamination gel according to the invention, maintain this gel on the surface during a period between 10 min to 5 hours and rinse the metal surface to remove this reducing gel, and 2) Apply on the surface so treated, an oxidizing gel in acid environment, maintain this gel on the surface for a period between 30 min to 5 hours and rinse the metal surface so treated to remove the oxidizing gel.

Or clearly the decontamination process could consist of the following stages:

a. spraying on the surface to be decontaminated a solution of sodium hydroxide for a period, for example of 30 minutes, b. rinsing with water c. application on the surface so treated of an oxidizing gel in acid environment and maintaining it on the surface for a period of 30 minutes to 5 hours, preferably for two hours d. rinsing with water.

The contact time can vary between wide limits and depends also on the type of the active decontamination agent and of the type of the organic thickening agent.

As an example, for an acid oxidizing gel containing a polyacrylic acid or TEXIPOL 63-510 as organic thickener, the contact period is preferably from 30 minutes to 5 hours, and more preferably from two to five hours.

For a reducing gel, the contact time would be preferably from 10 to 5 hours.

The application of gel over the metal surface to be decontaminated can be carried out by the standard procedures, for example from the spraying with the gun, soaking and draining, packaging or even by means of a paintbrush. Preferably, the gel is applied for spraying/sputtering with the gun, for example under pressure (Airless compressor) at the injector from 10 to 200 kg/cm$^2$ for example, from 10 to 160 kg/cm$^2$, for example also from 50 to 100 kg/cm$^2$.

The gel can be removed from the treated surface preferably by rinsing, it could also be removed by other means for example, mechanics or with a gas jet, for example with compressed air.

To carry out the rinsing, demineralized water or an aqueous solution is used in which the gel used can be dissolved or in which it can form a film that can be detached and washed away with water.

The rinsing could be done under pressure, which means with a pressure from 10 to 160 kg/cm$^2$.

According to a particular interesting characteristic of the invention, from the fact that the gels according to the invention, comprising a uniquely organic thickening agent keep for a prolonged period, could go up to 48 hours and more, their gel texture, rinsing of the surface is much more easy, can be done at a low pressure for example 15 kg/cm$^2$ or even without pressure and require a reduced quantity of demineralized water, for example less than 10 l/m$^2$.

The number of treatments (or passes) of the rinsing during a decontamination operation is reduced since the gel according to the invention does not include the mineral charge.

Again, as a result of the invention, the quantity of generated effluents defined especially from the volume of the rinsing effluents is greatly reduced.

On the contrary, the gels of the prior art, in which the thickening agent is partially or totally mineral, and which includes for example only the silica, become after application, and in a relatively short time, dry and cracked, their rinsing is very difficult and demand a larger amount of water under high pressure. Because of this, large quantities of the liquid effluents are generated.

The rinsing effluents are then treated appropriately, for example they can be neutralized, for example by the sodium hydroxide in the case where an acid gel has been used.

The effluents are then generally subjected to a solid-liquid separation, for example by filtration with a cartridge filter to give on the one hand, the effluent liquid, and on the other hand the solid wastes whose quantity is extremely reduced, even none, because of the very low mineral charge the gels according to the invention that in fact, come only from the active decontamination agent.

In the most cases, the quantity of the mineral in the gel according to the invention is likewise so low that it allows the transfer of the rinsing effluents towards an evaporator without any prior treatment.

The decontaminating gels of the invention can be prepared simply, for example by adding to an aqueous solution of constituent b) that is, of the active decontamination agent, the thickening agent, a) exclusively organic. In the case of an oxidizing gel in which the active agent b) includes, besides, the oxidizing agent, a mineral acid chosen, for example, among $HNO_3$, HCl, $H_3PO_4$, $H_2SO_4$, and their mixtures, preferably $HNO_3$, it turns out that the following preparation process was particularly advantageous, especially in terms of the preparation time; first are mixed the thickening agent a) the solution of mineral acid under agitation and possibly, heating, to solubilize the polymer and obtain the viscous and homogeneous acid gel and next to said acid gel is added, under agitation, the oxidizing agent, such as $(NH_4)_2Ce(NO_3)_6$.

The gels according to invention generally have a very long storage period; however the chemical inertia of certain surfactants although good is limited in time, for example in the presence of an oxidizing agent like Ce (IV).

The great solubility of these surfactants induces a rapid homogenization during their incorporation in the gel. Their introduction in the solution should be done, preferably then a short time before the usage of the gels for optimal effectiveness.

Other characteristics and advantages of the invention will better appear with the reading of the following examples given of course by way of illustration and non limitative.

EXAMPLE 1

Preparation of the oxidizing gels containing acrylic acid-acrylamide copolymer

Acid oxidizing gels are prepared which have $(NH_4)_2Ce(NO_3)_6$ as an active agent in nitric acid and which include an acrylic acid-acrylamide copolymer, namely, TEXIPOL 63 510, as an organic thickening agent.

Example 1A

In the first preparation series given by way of comparison, the gels prepared include silica (Cas-O-Sil M5) and are based on the gels described in the document FR-A-2 746 328.

These gels are prepared in the following manner: the solution of nitric acid and the "TEXIPOL" are moderately heated in a temperature of approximately 50° C. under agitation, the time to obtain a homogeneous mixture, the time can go from approximately 24 hours to approximately 48 hours.

After cooling at room temperature, the silica and $(NH_4)_2Ce(NO_3)_6$ are added; finally it is shaken for homogenizing.

The following table I, gathers the different compositions of the prepared samples.

TABLE I

| No | $SiO_2$(CabosilM5)/g | Texipol 63510/g | $(NH_4)_2Ce(NO_3)(1M)_6$/g | $HNO_3$ (2,88)/g |
|---|---|---|---|---|
| 1 | 4 | 1.5 | 38.4 | 56.1 |
| 2 | 3 | 2 | 38.4 | 56.6 |
| 3 | 2 | 3 | 38.4 | 56.6 |
| 4 | 1 | 4 | 38.4 | 56.6 |
| 5 | 0.5 | 5 | 38.4 | 56.1 |
| 6 | 0.5 | 8 | 38.4 | 53.1 |

During this first sampling, whatever the TEXIPOL® added increasing quantity may be, in order to compensate the diminution of the mineral load, the obtained viscosity is not sufficient to consider being used by spraying. On the contrary, the diminution of the silica load causes a loss of viscosity. Indeed, for samples 1 to 5, a decrease in the viscosity can be seen, at all shearing regimes up to obtaining liquids for numbers four and five.

Surprisingly, when the percentage of TEXIPOL® is increased, sufficient viscosity is obtained.

Thus, the sixth synthesis has effectively given rise to a gel, the viscosity of which has appeared to be very important. Then, the presence of silica in the medium has appeared to be secondary as regards the rheological properties of the gels and could have been removed altogether. In the following example, the compositions have been prepared according to the invention, the thickening mineral substance of which is zero.

Example 1B

The oxidizing gels without any mineral charge (in the thickening agent) have been prepared in the following manner: the TEXIPOL®, the concentration of which is greater than 5% by weight, is added under heat to the solution of nitric acid, and creates a homogeneous solution. It is then sufficient to add $(NH_4)_2Ce(NO_3)_6$ directly.

Demixing is produced during mixing; it is necessary to wait for some time while maintaining moderated agitation (from 3 to 10 days) depending of the TEXIPOL and $(NH_4)_2Ce(NO_3)_6$ contents of the gel before obtaining the gel.

In order to control more precisely the effect of the concentration of TEXIPOL® on the viscosity by being free from the effect of the salt caused by the presence of a metal salt in the medium, there have gels prepared whose concentration in $(NH_4)_2Ce(NO_3)_6$ has been reduced from 1M to 0,5M. The compositions of these gels are shown in the following table II.

TABLE II

| No | Name | Texipol 63510/g | $(NH_4)_2Ce(NO_3)_6$/g | $HNO_3$ (2.88M) in gram |
|---|---|---|---|---|
| 7 | $Tg8^{0.5}$ | 8 | 20 (0.5M) | 72 |
| 8 | $Tg10^{0.5}$ | 10 | 20 (0.5M) | 70 |
| 9 | $Tg12^{0.5}$ | 12 | 20 (0.5M) | 68 |

To qualitatively determine the percentage of Texipol necessary for a good viscosity of the gels, a series of eight syntheses with different percentages of Texipol (from 9 to 20% by weight) has been carried out. Table III gives the compositions of each of the gels. The concentration in $(NH_4)_2Ce(NO_3)_6$ is constant and is approximately 1M.

TABLE III

| No | Name | Texipol 63510/g | $(NH_4)_2Ce(NO_3)_6$/g | $HNO_3$ (2,88M)/g |
|---|---|---|---|---|
| 10 | Tg9 | 9 | 33.5 (1M) | 57.5 |
| 11 | Tg10 | 10 | 33.5 | 56.5 |
| 12 | Tg11 | 11 | 33.5 | 55.5 |
| 13 | Tg12 | 12 | 33.6 | 54.4 |
| 14 | Tg13 | 13 | 33.6 | 53.4 |
| 15 | Tg14 | 14 | 33.6 | 52.4 |
| 16 | Tg15 | 15 | 33.6 | 51.4 |
| 17 | Tg16 | 20 | 33.2 | 46.8 |

It has been reported that the gels with low concentration of cerium (No. 7, 8 and 9) have a less viscous appearance than their homologues whose concentration is higher. Their coloration is also paler.

The more elevated the Texipol percentage, the higher the viscosity, and subsequently the preparation time is shorter.

In order to study the influence of the increase of Ce (IV) concerning rheology and corrosion, the following gels have been elaborated for a constant percentage by weight of Texipol (11 g/h) able to give the best results (in rheology) only the concentration of $(NH_4)_2Ce(NO_3)_6$ has been modified.

Table IV gives the compositions of each gel at a constant concentration of TEXIPOL.

TABLE IV

| No | Name | Texipol 63510/g | $(NH_4)_2Ce(NO_3)_6$/g | $HNO_3$ (2,88M)/g |
|---|---|---|---|---|
| 18 | Tg11,1 | 11 | 33.5 | 55.5 |
| 19 | Tg11,2 | 11 | 34.5 | 54.5 |
| 20 | Tg11,3 | 11 | 35.5 | 53.5 |
| 21 | Tg11,4 | 11 | 36.5 | 52.5 |

Example 2

The following examples illustrate the overall tendency to corrosion-erosion of the gels prepared in the above-mentioned example 1, according to the invention, and containing Texipol (acrylic acid copolymer, acrylamide). The preparation mode of these tests is as follows:

Over a steel plate 316L (density≈7.9 g/cm$^{-3}$) of 100 cm$^2$, with known mass, a certain quantity of gel is applied during a given time. It is then rinsed under low water pressure and the plate is dried and weighed. The corresponding erosion is expressed in $\mu$m.

Thirty-nine measurements have been conducted in order to studying the corrosion power of different gels depending on factors as:

The quantity of gel applied

The cerium (IV) concentration of the gel

The application time

"The age" of the gel

The quantity of the polymer

The prior treatment of the surface (the number of passes, etc).

The results are assembled in the following table V.

TABLE V

Recapitulative data concerning the corrosion power

| No | Name | Time of application | Quantity in g/cm. | Mass/ mg | Thickness/ $\mu$m |
|---|---|---|---|---|---|
| 1 | Tg12 | 2 hours | 0.1 | 25 | 0.3 |
| 2 | Tg12 | 14 hours | 0.1 | 32 | 0.38 |
| 3 | Tg15 | 3½ hours | 0.1 | 16 | 0.19 |
| 4 | $Tg12^{0.5}$ | 2 hours | 0.1 | 15 | 0.18 |
| 5 | Tg11 | 2 hours | 0.1 | 21 | 0.25 |
| 6 | Tg11 | 2 hours | 0.2 | 21 | 0.25 |
| 7 | Tg10 | 2 hours | 0.1 | 19 | 0.23 |
| 8 | Tg10 | 2 hours | 0.1 | 16 | 0.19 |
| 9 | Tg12/red | 2 hours | 0.1 | 13 | 0.15 |
| 10 | Tg12/ox/re | 2 hours | 0.1 | 20 | 0.24 |
| 11 | Tg20dop | 2 hours | 0.1 | 20 | 0.24 |
| 12 | Tg9 | 2 hours | 0.1 | 18 | 0.21 |
| 13 | Tg10 | 2 hours | 0.1 | 17 | 0.20 |
| 14 | Tg20dop | 2 hours | 0.1 | 7 | 0.08 |
| 15 | Tg9/ox | 2 hours | 0.1 | 21 | 0.25 |
| 16 | Tg10/ox | 2 hours | 0.1 | 15 | 0.18 |
| 17 | Tg15/recyc | 2 hours | 0–1 | 22 | 0.26 |
| 18 | Tg11,1 | 2 hours | 0.1 | 19 | 0.23 |
| 19 | Tg11,2 | 2 hours | 0.1 | 19 | 0.23 |
| 20 | Tg11,1 | 2 hours | 0.1 | 11 | 0.13 |
| 21 | Tg11,2 | 2 hours | 0.1 | 12 | 0.14 |
| 22 | Tg11,3 | 2 hours | 0.1 | 15 | 0.18 |
| 23 | Tg11,4 | 2 hours | 0.1 | 15 | 0.18 |
| 24 | Tg12 | 2 hours | 0.1 | 9 | 0.11 |
| 25 | Tg13 | 2 hours | 0.1 | 8 | 0.09 |
| 26 | Tg11,1 | 2 hours | 0.1 | 9 | 0.11 |
| 27 | Tg11,2 | 2 hours | 0.1 | 10 | 0.12 |

TABLE V-continued

Recapitulative data concerning the corrosion power

| No | Name | Time of application | Quantity in g/cm. | Mass/ mg | Thickness/ $\mu$m |
|---|---|---|---|---|---|
| 28 | Tg11,3 | 2 hours | 0.1 | 12 | 0.14 |
| 29 | Tg11,4 | 2 hours | 0–1 | 13 | 0.15 |
| 30 | Tg12 | 2 hours | 0–1 | 8 | 0.09 |
| 31 | Tg13 | 2 hours | 0.1 | 6 | 0.07 |
| 32 | Tg11,2/ox | 2 hours | 0.1 | 8 | 0.09 |
| 33 | Tg11,3/ox | 2 hours | 0.1 | 10 | 0.12 |
| 34 | Tg11,4/ox | 2 hours | 0.1 | 11 | 0.13 |

The highest corrosion power is 0.3 $\mu$m for gel No. 1, after only one treatment for two hours and a quantity of gel equal to 1 kg/m$^2$.

The corrosive power seems to be limited to a value of about 0,4 $\mu$m. This is indeed the maximum thickness eroded during the experimentation over an application period of 14 hours. ($N_0$2). The gel became colourless, translucent and has not dried; it is easily cleaned with water under low pressure.

This limited value has required other tests to try to define the parameters which might increase corrosion. Thus, at first, the quantity of gel had doubled. The mass of the corroded steel, on the contrary, has not been multiplied by two, and the eroded thickness is strictly equivalent ($N_0$ 5 and 6). So the quantity of the oxidizing gels applied that are synthesized with Texipol seems not to have any influence on the corrosion power.

Concerning the effect of concentration of cerium (IV), the comparison of the results obtained in the experiments No. 1 and 4, shows, as could be expected, that a gel $Tg12^{0,5}$ (No.4) with cerium concentration halved compared with Tg12 corrodes less efficiently. Similarly, samples Tg11.1, Tg11.2, Tg11.3 and Tg11.4 (No. 20, 21, 22 and 23) confirm the strong relation between the concentration of Ce (IV) and the corrosion power.

If we take into account the influence of the titre of cerium (IV), and the tendency of the polymer to be oxidized, it appears clearly that the "age" of the gel causes a decreasing development of the oxidizing power. The study of the corrosion of a gel at 2–3 day intervals carried out on gels No. 19, 21, 27, and 32 shows clearly this decrease.

The gels having the strongest corroding power are Tg11,1 and Tg11,2 that paradoxically have the lowest initial titres of Ce(IV). Furthermore, it can be observed that the longer the setting time of the gel, the better the corrosion. Indeed, the oxidation of the polymer reduces the concentration of Ce(IV) in the gel. However, the higher the initial titre of cerium, the longer the setting time of the gel. An optimal formulation is a balance between a percentage by weight of Texipol and an ideal concentration of Ce(IV), which should not be too low, because this will give a low corrosion, neither too high, because this will give too long a setting time and thus a low corrosion.

Furthermore, the optimal percentage of Texipol should be, at the same time, sufficient to impart a value of the viscosity which is necessary for adherence of the gel, and minimal to allow good corrosion.

Finally, it also appears as regards the experiments No. 9 and 10 that prior treatment of the surface with an oxidizing gel substantially increases the effectiveness of the gel.

EXAMPLE 3

A Preparation of the Acid Oxidizing Gels Containing a Polyacrylic Acid Polymer

The following operational mode has been used for the preparation of the oxidizing gels including nitric acid and $(NH_4)_2Ce(NO_3)_6$, with the exception of those where the gels contain silica.

At first, we mix the polymer and the solution of nitric acid. The polymer quickly becomes soluble under manual agitation for about 15 minutes. A gel is thus obtained which is very viscous, homogeneous, and white coloured. This acid gel has rather long lifetime and can be prepared days in advance. $(NH_4)_2Ce(NO_3)_6$ is then added paying attention that the mixture is always homogeneous. The formation of lumps in $(NH_4)_2Ce(NO_3)_6$ is avoided. The adding of diammonium hexanitroacetate entails fluidization of the mixture. The mixture should rest for about one hour; this is necessary to obtaining a sprayable gel.

Examples 4 to 13

These examples illustrate the power of generalized corrosion-erosion of the gels according to the invention, as well as the gels containing, in addition to the organic thickening polymer, silica as mineral thickener. The gels studied in these examples are acid oxidizing gel containing nitric acid and cerium hexanitroacetate. The thickening polymer is polyacrylic acid.

The general operational mode for studying the power of generalized corrosion-erosion is:

We have studied the power of generalized corrosion-erosion of each of the gels in the following manner; on a steel plate 316L (d=7.9) of 100 $cm^2$ of known mass, we have applied a certain quantity of gel for a given time, this then being rinsed under low-pressure water and the plate is dried and weighed. The corresponding erosion is expressed in micrometers.

Example 4

This example illustrates the influence of the concentration of nitric acid on the corrosion properties of the gels.

We can then determine the titre of the nitric acid solution that generally gives optimal corrosion power.

Two preparations, distinct by the titre of nitric acid have been applied for a generalized measure of the erosion. Their formulation is:

Gel (2M): 3 g (of polyacrylic acid (4 millions))+33 g (of $(NH_4)_2Ce(NO_3)_6$)+50 g (of $HNO_3$ 2M)

Gel (2M): 3 g (of polyacrylic acid (4 millions))+33 g (of $(NH_4)_2Ce(NO_3)_6$+50 g (of $HNO_3$ 2,88M)

The respective results concerning the loss of mass and generalized erosion are: 55 and 81 mg for an application of 10 g of gel over 100 cm2 of steel 316L for 2 hours.

The 2.88M gel in $HNO_3$ corrodes better than the 2M gel. The loss of mass is 26 mg higher, which corresponds to additional erosion of 32%. The role played by the titre of nitric acid is decisive in the erosion for a constant concentration of $(NH_4)_2Ce(NO_3)_6$. An efficient formulation D (see below) could have been developed.

EXAMPLE 5

In this example, tests have been performed concerning corrosion with different gels A, Br C, D whose formulation is described in the following table VI.

TABLE VI

| Gel * | Polymer in gram or % | $(NH_4)2Ce(NO_3)_6$ in gram | $HNO_3$ 2,88M in gram |
|---|---|---|---|
| A | 4.2 | 35.9 (i.e 0,8M) | 59.9 |
| B | 3.6 | 36.1 (i.e 0,8M) | 60.3 |
| C | 3.7 | 38.3 (i.e 0,9M) | 58 |
| D | 3.5 | 38.4 (i.e 0,9M) | 58.1 |

* The measure of the specific gravity of the gels gives 1.45.

The gels A and B have been prepared to decrease the titre of $(NH_4)_2Ce(NO_3)_6$ in order to lower even more the mineral charge while conserving a good corrosion power.

The gel C has been prepared to optimize the viscosity.

The gel D (see above) has been prepared to optimize the concentration of $HNO_3$.

EXAMPLE 6

Tests with gel A;

On the surface of a plate of steel 316L arranged vertically, the gel has remained applied for 4 hours without being removed from the surface. A minor liquid phase has run. The erosion is 95 mg, that is to say 1.14 $\mu$m. The gel rinses easily. For an application of 2 hours, a loss of weight of 72 mg or 0.86 $\mu$m is obtained.

EXAMPLE 7

Tests with gel B:

Under the same conditions as for the gel A, the gel B has not run after 4 hours of application. It is rinsed easily. The erosion is 102 mg, or 1.22 $\mu$m.

A study of the variation, during the first hours after the gel is set, the corrosion power of the gel has been carried out: the gel is applied in one hour intervals on different plates of steel 316L for a period of 2 hours. The first application is carried out at $t=t_0$ ($t_0$ being the time where the gel is considered to be completely sprayable). At $t1=t_0+1$ hour, another plate is coated, and so on.

The table VII assembles the related data related to the change in the corrosion power of gel B.

TABLE VII

| Time | Duration of application | Loss of mass in mg | Thickness in $\mu$m |
|---|---|---|---|
| t0 | 2 hours | 59 | 0.71 |
| t1 = t0 +1 h | 2 hours | 64 | 0.77 |
| t2 = t0 +2 h | 2 hours | 61 | 0.73 |
| t3 = t0 +3 h | 2 hours | 55 | 0.66 |
| t4 = t0 +4 h | 2 hours | 62 | 0.74 |
| t6 = t0 +6 h | 2 hours | 62 | 0.74 |

The values of thickness eroded are spread in a narrow margin between 0.66 and 0.77 $\mu$m for a period of application of two hours. No change in the corrosion power of the gel is noted in the lapse of time considered from $t_0$ to $t_0$+6 h.

EXAMPLE 8

Tests with gel C:

Three corrosion experiments have been carried out: during the first two experiments, gel C is applied on a vertical wall (wall), or over a horizontal wall towards the other side (ceiling) for at least four hours to check the good adherence of the gel during the process of erosion.

In a third experiment, the gel is spread over a horizontal surface (floor) during two hours. Whatever the mode of application (wall, ceiling or floor), the gel has not run and the rinsing has been very easy.

EXAMPLE 9

Tests with gel D:

The eroded thickness as a function of the duration of application of the gel has been measured. Rinsing of the gel is in all cases very easy.

The related results of the experiments of corrosion with gels A, B, C, D are assembled in table VIII.

TABLE VIII

| Gel | Position | T ° C. | Duration of application | Quantity ($kg/M^2$) | Mass (mg) | Thickness in ($\mu$m) |
|---|---|---|---|---|---|---|
| A | S | 25 | 2 hours | 1 | 72 | 0.86 |
| B | S | 25 | 2 hours | 1 | 61 | 0.73 |
| C | S | 25 | 2 hours | 1 | 61 | 0.73 |
| D | S | 25 | 2 hours | 1 | 79 | 0.95 |
| A | V | 25 | 4 hours | 1 | 95 | 1.14 |
| B | V | 25 | 4 hours | 1 | 102 | 1.22 |
| C | V | 25 | 4 hours | 1 | 111 | 1.33 |
| D | S | 25 | 4 hours | 1 | 105 | 1.26 |
| D | S | 25 | 3 hours | 1 | 98 | 1.18 |
| C | P | 25 | 4 hours | 1 | 111 | 1.33 |
| C | S | 25 | 3 hours | 1 | 104 | 1.25 |
| C | S | 25 | 3 hours | 1 | 103 | 1.24 |
| C | S | 25 | 4 hours | 1 | 94 | 1.13 |
| C | S | 25 | 4 hours | 0.5 | 56 | 0.67 |
| C | S | 40 | 2 hours | 1 | 89 | 1.07 |
| C | S | 80 | 2 hours | 1 | 79 | 0.95 |
| C | S | 25 | 12 hours | 1 | 120 | 1.44 |
| C* | V | 25 | 24 hours | 1 | 87 | 1.04 |
| C | S' | 25 | 3 hours | 1 | 104 | 1.25 |
| C | S" | 25 | 3 hours | 1 | 111 | 1.33 |
| C | S' | 25 | 4 hours | 1 | 107 | 1.28 |
| C | S" | 25 | 4 hours | 1 | 121 | 1.45 |

Legends: (*) corrosion done the day following the synthesis; (') surface already oxidized; (") second pass; "S" for floor; "p" ceiling; "V" for vertical.

The limit of erosion of gel C in the first pass is 120 mg (1.44 $\mu$m) for a period of application of 12 hours. The period of application influences the corrosion that is important during the first four hours of contact.

By comparing the corrosion power of the gels that have appreciably different titres of cerium (IV) (0.8 M for the gels A and B and 0.9 M for the gels C and D), it is noted that the decrease of the titre of Ce (IV) does not cause a decrease in the corrosion power on an application of two hours. On the other hand, the effect of a decrease of corrosion can be observed on an application of four hours although there is only a difference of 0.2 $\mu$m between the two extreme erosions.

The quantity of gel applied influences the corrosion. For the same gel, the losses of weight have 94 mg every 1 $kg/m^2$ and 56 mg every 0.5 kg.

An increase of the temperature of the plate causes a drying of the gel. At 40° C. the gel dries in an hour and at 40° C. in half an hour. Eroded thicknesses of 1.07 $\mu$m and 0.95 $\mu$m, respectively, are obtained. Considering that the corrosion is only effective if the gel is wet, it is noted that the increase of the temperature leads to a higher hourly erosion. Rinsing of the plate is very easy at 40° C. and somewhat less easy for the one at 80° C.

The corrosion power does not decrease during the first hours of use of the gel (more than 24 hours). However, the corrosion experiments carried out from gels having been prepared 24 hours before have shown that corrosion decreases slightly. Indeed, the limit corrosion decreases from 1.44 $\mu$m for a gel applied immediately after being prepared and this, during 12 hours, to 1.04 $\mu$m for a liquid gel applied 24 hours after its preparation.

The different experiments carried out on the viscosity of the gels have shown a good adherence of the gels over the vertical (wall) and horizontal (ceiling) walls on a period of application of more than four hours. A test has been carried out to estimate the time of adherence of the gel on the vertical walls. The gel had remained applied for 24 hours on a plate vertical without lifting up. However, it allows a small quantity to flow out. The plate is perfectly well rinsed under water at low pressure.

A second pass of gel always increases the corrosion power when the passes are made as part of a gel taken from the same "age" (in the first six hours the corrosion power of the gel does not diminish). One corrosion for example would pass in the first class from 1,28 $\mu$m, to an erosion of 1,45 $\mu$m, in the second pass for two successive passes of 4 hours each with gel C.

A common characteristic in all the gels is the lifetime of 24 hours beyond which the gel losses its viscose structure little by little.

EXAMPLE 10

This example illustrates the influence of the concentration of the polymer on the corrosion.

For this purpose, four gels P1, P2, P3, P4 were prepared.

The corrosion power decreases from P1 to P4, it passes from 0,89 m, to 0,70 m. Since the concentration of the polymer increases from P1 to P4, it is also noted that the increase in the percentage of the polymer in the environment (for a titre constant of Ce (IV) causes a decrease in the corrosion power. It should be noted moreover, that the viscosity of the gel increases with the concentration of the polymer from P1 to P4. Too high a viscosity of gels leads in a non-uniform spreading over the surface. The lumps of the gel become red during the time of the application and do allow not even a participation in the corrosion of all the quantity of the gel applied initially. Table IX gathers the results for P1, P2, P3, and P4. The period of the application of the gel is three hours and the quantity applied is 1 kg/m2.

TABLE IX

| Gel | Polymer [4] in gram | $(NH_4)_2$ $Ce(NO_3)_6$ | $HNO_3$ 2,88M | Weight Lost in gram | Thickness in (m) |
|---|---|---|---|---|---|
| P1 | 4 | 57.8 | 38.2 | 74 | 0.89 |
| P2 | 4.6 | 57.5 | 37.9 | 72 | 0.86 |
| P3 | 5.1 | 57.2 | 37.7 | 62 | 0.74 |
| P4 | 5.7 | 56.8 | 37.5 | 58 | 0.70 |

EXAMPLE 11

This example illustrates the influence of the concentration of cerium on the corrosion.

For this purpose, four gels A1, B1, C1, D1 were prepared.

The samples A1, B1, C1 D1 confirm the influence of the concentration of Ce(IV) on the corrosion power in an environment containing a polymer of polyacrylic acid. At constant concentration of the polymer, the significant increase in the titre of Ce(IV) increases the corrosion power. We will observe that the day following of the synthesis a second pass gives weaker erosion. For example for C1, from an average of erosion of 0,31 m/h when the corrosion is carried out the same day as the synthesis, the limit become 0,26 μm/h.

TABLE XII

| Gel | Position | Temperature in ° C. | Application's duration | Quantity (kg/m2) | Lost weight (mg) | Thickness (μm) |
|---|---|---|---|---|---|---|
| 1 A8 | S | 25 | 1 hour | 1 | 28 | 0.34 |
| 2 B8 | S | 25 | 1 hour | 1 | 23 | 0.28 |
| 3 A8* | S | 25 | 1 hour | 1 | 21 | 0.25 |
| 4 A10 | S | 25 | 1 hour | 1 | 21 | 0.25 |
| 5 A8 | S | 25 | 1 hour | 1 | 18 | 0.22 |
| 6 A8 | S | 25 | 2 hour | 1 | 53 | 0.64 |
| 7 A8 | S | 25 | 3 hour | 1 | 92 | 1.1 |
| 8 A8 | S | 25 | 18 hour | 1 | 128 | 1.54 |
| 9 AB1* | S | 25 | 1 hour | 1 | 11 | 0.13 |
| 10 AB1* | S | 25 | 2 hour | 1 | 36 | 0.43 |
| 11 AB1* | S | 25 | 3 hour | 1 | 55 | 0.66 |
| 12 AB1* | S | 25 | 4 hour | 1 | 106 | 1.27 |
| 13 B13 | S | 25 | 1 hour | 1 | 21 | 0.25 |
| 14 B13 | S | 25 | 2 hour | 1 | 48 | 0.58 |
| 15 B13 | S | 25 | 3 hour | 1 | 89 | 1.07 |

*Corrosion done day following synthesis.

S) The plate in the horizontal position "floor"

EXAMPLE 13

In this example we have prepared the gel incorporating a polyacrylic acid and a surf actant of the polyoxyethylene type.

Table XIII gives the compositions of each of these gels.

TABLE XIII

| No | Gel | $C_6E_2$ in g | $C_{12}E_4$ in g | Polyacrylic acid (M = 450 000 g · mol−1) in g | $(NH_4)_2$ $Ce(NO_3)$hd 6 (1.2M) $HNO_3$ (2M) |
|---|---|---|---|---|---|
| 22 | Poly 3, 62 | 0.5 | 0 | 3 | 46.5 |
| 23 | Poly 3, 13 | 0 | 0.5 | 3 | 46.5 |
| 24 | Poly 3, 8 | 0 | 0 | 3, 8 | 46.2 |

The cerium solution $(NH_4)_2Ce(NO_3)_6$ (1,2M)+$HNO_3$ (2M) is mixed directly with the polymer and the surfactant. The mixture becomes homogeneous by agitation.

Table XIV sums up the results concerning the corrosive power of these gels.

Three syntheses have resulted in the formation of a gel. In the vitreous and homogeneous appearance of the gel obtained, it appears that the surfactants play their role fully in the solubility process. In the case of $C_6E_2$, the presence of the surfactant brings a greater additional viscosity. On the contrary, $C_{12}E_4$ does bring only a low gain in viscosity. Without the surfactant, gel 23 keeps a good structure for at least two days.

TABLE XIV

| No | Gel | Duration of the application | Quantity in g/cm$^2$ | Weight in g | Thickness in μm |
|---|---|---|---|---|---|
| 35 | Pol 4.62 | 2 hours | 0.1 | 11 | 0.13 |
| 36 | Pol 4.124 | 2 hours | 0.1 | 29 | 0.35 |
| 37 | Pol 4.124 | 2 hours | 0.1 | 25 | 0.3 |
| 38 | Pol 3.8 | 2 hours | 0.1 | 59 | 0.7 |
| 39 | Pol 3.8 | 2 hours | 0.06 | 52 | 0.62 |

In the following examples, we have prepared the basic gels, and basic gels and reducing agents according to the invention in which the organic thickening agent is a copolymer of acrylic acid and acrylamide (Texipol®).

The gels include sodium hydroxide, or sodium borohydride in the sodium hydroxide as active agents. Gels that contain alumina are also prepared by way of comparison.

The gels are prepared in the following manner:

for basic gels, it is sufficient to mix Texipol and alumina directly with the sodium hydroxide for the first series of samples. In the second series alumina is no longer present.

for the reducing gels, the procedure is the same way from taking a solution of sodium hydroxide (3M) with sodium borohydride ($NaBH_4$) (3M).

After agitation, if the gels do not set instantly, we should wait from 1 to 2 hours and mix them again.

EXAMPLE 14

Basic Gels

From the formulation of the alumina-based basic gels described in the patent FR-A-2 746 328, first a decrease of the alumina charge was attempted compensated by an equal increase of the weight of Texipol. The first series of the formulation is presented in the following table XV.

TABLE XV

| No | $Al_2O_3$ in gram | TEXIPOL in gram | NaOH (3M) in gram |
|---|---|---|---|
| 1 | 4 | 1 | 95 |
| 2 | 3 | 2 | 95 |
| 3 | 2 | 3 | 95 |
| 4 | 1 | 4 | 95 |
| 5 | 0.5 | 5 | 94.5 |

These first samples surprisingly show that an increase of the quantity of polymers from a threshold is expressed by the formation of gel. It is then possible for the oxidizing gel to create a gel entirely thickened by the polymer.

The second series is created on the progressive increase of the quantity of polymer until obtaining the gel with a sufficient viscosity. The table XVI gathers the compositions of these basic gels according to the invention.

TABLE XVI

The formulation of the gel basic

| No | Gel | TEXIPOL in gram | NaOH (3M) in gram |
|---|---|---|---|
| 6 | Tgb6 | 6 | 94 |
| 7 | Tgb7 | 7 | 93 |
| 8 | Tgb8 | 8 | 92 |
| 9 | Tgb9 | 9 | 91 |
| 10 | Tgb10 | 10 | 90 |
| 11 | Tgb11 | 11 | 89 |

We obtain immediately with the mixture, a whitish gel. The gel sets all the more strongly if the percentage of the Texipol is high.

EXAMPLE 15

Reducing Gels

The easy use of these basic gels has pushed us to try directly for the synthesis of the reducing gels, the mixture of the reducing solution of NaOH (3M)/$NaBH_4$ (3M) with Texipol.

The reducing gels prepared all have the same appearence, identical with that of the basic gels, in the beginning of the process. Subsequently, the gels uniformed imprison big quantity of bubbles A longer setting time (approximately two hours) can be noted for the lower percentages of Texipol (<10%). Their formations are percented in table XVII.

TABLE XVII

The formulation of reducing gels

| No | Gel | TEXIPOL in gram | $NaBH_4$ (3M) NaOH (3M) in gram |
|---|---|---|---|
| 1 | Tgbh8 | 8 | 92 |
| 2 | Tgbh9 | 9 | 91 |
| 3 | Tgbh10 | 10 | 90 |
| 4 | Tgbh11 | 11 | 89 |
| 5 | Tgbh12 | 12 | 88 |

What is claimed is:

1. Decontamination gel comprising:

a) a thickening agent;

b) an active decontamination agent;

c) in which the thickening agent (a) is exclusively an organic thickening agent, which is a water-soluble organic polymer chosen from polymers of acrylic acid and copolymers of acrylic acid with acrylamide; said gel further comprising, an organic surfactant chosen from the polyoxyethylenic ethers with formula (II):

$$CH_3—(CH_2)_{n-1}—(O—CH_2—CH_2)_m—OH \quad (I)$$

also called $C_nE_m$;

where "n" is an integer from 6 to 18, and "m" is an integer from 1 to 23.

2. Gel according to claim 1, in which said organic polymer is present at a content of 1 to 11% by weight, preferably 2 to 8% by weight.

3. Gel according to claim 1, in which said polymer has a molecular weight by weight of 200,000 to 5,000,000 g/mol.

4. Gel according to claim 1, in which said copolymer of acrylic acid with acrylamide has the following formula (I)

$$—(CH_2—\underset{\underset{CONH_2}{|}}{CH})_x—(CH_2—\underset{\underset{COOH}{|}}{CH}—)_y \quad (I).$$

5. Gel according to claim 1, in which said surfactant of formula (II) is the compound called $C_6E_2$ (di(ethylene glycol) hexyl ether), the compound called $C_{10}E_3$ or the compound called $C_{12}E_4$.

6. Gel according to claim 1, in which said organic surfactant is present at a content of 0.1 to 5% by weight.

7. Gel according to any one of claims 1 to 6, called "acid gel" characterized in that the active decontamination agent (b) comprises a mineral acid.

8. Gel according to claim 7, characterized in that the mineral acid is chosen among hydrochloric acid, nitric acid, sulphuric acid, phosphoric acid and their mixtures.

9. Gel according to claim 7, characterized in that the mineral acid is present at a concentration of 1 to 10 mol/l.

10. Gel according to any one of claims 1 to 6, characterized in that the active decontamination agent (b) includes a mineral base.

11. Gel according to claim 10, characterized in that the mineral base is chosen among sodium hydroxide, potassium hydroxide and their mixtures.

12. Gel according to claim 10, characterized in that the mineral base is present at a concentration of 0.1 to 14 mol/l.

13. Gel according to any of claims 1 to 6, called "reducing gel", characterized in that the active decontamination agent (b) includes a reducing agent.

14. Gel according to claim 13, characterized in that the reducing agent has a standard redox potential $E_0$ less than −600 mV/ENH (normal hydrogen electrode) in strong base environment (pH≧13).

15. Gel according to claim 13, characterized in that the reducing agent is present in concentration of 0.1 to 4.5 mol/l.

16. Gel according to claim 14, characterized in that the reducing agent is chosen among borohydrides, sulphites, hydrosulphites, sulphides, hypophosphites, zinc, hydrazine and their mixtures.

17. Gel according to claim 14, characterized in that the active agent (b) includes a mineral base in a concentration of 0.1 to 14 mol/l.

18. Gel according to any one of claims 1 to 6, called "oxidizing gel", characterized in that the active decontamination agent (b) includes an oxidizing agent or the reduced form of said oxidizing agent.

19. Gel according to claim 18, characterized in that the oxidizing agent has a standard redox potential $E_0$ greater than 1,400 mV/ENH (normal hydrogen electrode) in strong acid environment (pH<1).

20. Gel according to claim 18, characterized in that oxidizing agent is present at a concentration of 0.1 to 2 mol/l.

21. Gel according to claim 19, characterized in that the oxidizing agent is chosen among $Ce^{IV}$, $Ag^{II}$, $Co^{III}$ and their mixtures.

22. Gel according to claim 21, characterized in that $Ce^{IV}$ is in the form of cerium nitrate, cerium sulphate or diammonium hexanitrato cerate.

23. Gel according to claim 19, characterized in that the oxidizing gel includes, in addition to the reduced form of oxidizing agent, a compound able to oxidize the reduced form of this oxidizing agent.

24. Gel according to claim 23, characterized in that the compound, able to oxidize the reduced form of the oxidizing agent, is an alkali metal persulphate.

25. Gel according to claim 19, characterized in that the active agent (b) includes, in addition to the oxidizing agent, a mineral acid or a mineral base at a concentration of 1 to 10 mol/l.

26. Gel according claim 25, characterized in that the mineral acid is chosen among $HNO_3$, HCl, $H_3PO_4$, $H_2SO_4$ and their mixtures.

27. Alkaline decontamination gel according claim 10, comprising:

9 to 11% by weight of acrylic acid-acrylamide copolymer having a weight-average molecular weight of 200,000 and containing 20% by weight of acrylamide;

1 mol/l to 12 mol/l of sodium hydroxide.

28. Reducing decontamination gel according to claim 17, comprising:

9 to 11% by weight of acrylic acid-acrylamide copolymer having a weight-average molecular weight of 200,000 and containing 20% by weight of acrylamide;

1 mol/l to 12 mol/l of sodium hydroxide;

1 to 4 mol/l of $NaBH_4$.

29. Oxidizing decontamination gel according to claim 18, comprising:

10 to 13% by weight of acrylic acid-acrylamide copolymer having a weight-average molecular weight of 200,000 and containing 20% by weight of acrylamide;

2 to 3 mol/l HN;

0.1 to 2 mol/l of $(NH_4)_2Ce(NO_3)_6$.

30. Oxidizing decontamination gel according to claim 18, comprising:

0.6 to 1.2 mol/l of $(NH_4)_2Ce(NO_3)_6$ or $Ce(NO_3)_4$;

from 2 to 3 mol/l of $HNO_3$;

3 to 4.5% by weight of polyacrylic acid having a weight-average molecular weight of 4,000,000.

31. Oxidizing decontamination gel according to claim 18, characterized in that said gel comprises:

7 to 8% by weight of polyacrylic acid having a weight-average molecular weight of 450,000;

2 to 3 mol/l of $HNO_3$;

0.1 to 2 mol/l of $(NH_4)_2Ce(NO_3)_6$;

up to 1% by weight of surfactants.

32. Process for preparing an oxidizing gel according to claim 25 or 26 wherein the active agent (b) includes, in addition to the oxidizing agent, a mineral acid, wherein, in a first step the thickening agent (a) is blended under mixing and optionaly heating with a solution of mineral acid, in order to dissolve the polymer and to obtain a viscous and homogenous acid gel, and in a second step an oxidizing agent such as $(NH_3)_2Ce(NO_3)_6$ is added under mixing, into the above-mentioned acid gel.

33. Process of decontamination of a metal surface including: applying on the surface to be decontaminated a gel according to claim 1; maintaining this gel on the surface for a sufficient to achieve the decontamination, removing said gel from the metal surface so treated.

34. Process according to claim 33, wherein the surface to be decontaminated is at a temperature greater than or equal to 40° C.

35. Process according to claim 33, wherein the gel is applied by spraying with a spray gun.

36. Process of decontamination according to claim 33, wherein the gel is maintained on the surface for a time period between 10 minutes and 24 hours.

37. Process of decontamination according to claim 33, wherein the gel is an oxidizing acid gel and wherein said gel is applied on the surface for a period of time between 2 and 5 hours.

38. Process according to claim 33, wherein the gel is removed from the surface by rinsing.

39. Process according to claim 33, wherein the gel is applied on the surface at the rate of 100 g to 2,000 g/m2.

* * * * *